US007900304B2

(12) United States Patent
Bihlmaier

(10) Patent No.: US 7,900,304 B2
(45) Date of Patent: Mar. 8, 2011

(54) MULTIFUNCTION TOOL FOR SERVICING CHAIN SAWS

(76) Inventor: Michael Bihlmaier, Marengo, IL (US)

( * ) Notice: Subject to any disclaimer, the term of this patent is extended or adjusted under 35 U.S.C. 154(b) by 0 days.

(21) Appl. No.: 12/387,669

(22) Filed: May 6, 2009

(65) Prior Publication Data

US 2010/0281620 A1 Nov. 11, 2010

(51) Int. Cl.
*B25F 1/00* (2006.01)
*A46B 15/00* (2006.01)

(52) U.S. Cl. ..... 7/138; 15/105; 7/165

(58) Field of Classification Search ..... 7/138, 100, 7/165, 167, 118, 170; 81/125.1, 451, 177.5, 81/124.4; 15/88, 104.03, 104.04, 104.05, 15/104.011, 105, 106, 111
See application file for complete search history.

(56) References Cited

U.S. PATENT DOCUMENTS

| | | | | | |
|---|---|---|---|---|---|
| 74,490 | A * | 2/1868 | Bidwell | 7/165 |
| 914,970 | A * | 3/1909 | Nickerson et al. | 15/184 |
| 2,094,432 | A * | 9/1937 | Pazzano | 7/165 |
| 2,293,081 | A * | 8/1942 | Savoy | 15/111 |
| 3,680,159 | A * | 8/1972 | Wharram | 7/100 |
| 4,736,658 | A * | 4/1988 | Jore | 81/451 |
| 5,285,543 | A * | 2/1994 | Rowe | 7/138 |
| 5,458,030 | A * | 10/1995 | Betts | 81/451 |
| 6,393,645 | B1 * | 5/2002 | Kadinger | 15/104.04 |
| 6,865,760 | B2 * | 3/2005 | Oberndorfer | 7/138 |

* cited by examiner

*Primary Examiner* — Hadi Shakeri
(74) *Attorney, Agent, or Firm* — Marshall A. Burmeister

(57) ABSTRACT

A single tool functioning as a screwdriver, a socket wrench and a brush. A shaft serves as an element of a screwdriver, the shaft of a socket wrench and a handle and support for a brush; In one embodiment, a tube with sockets at both ends is attached at its center to one end of a shaft that is also slidably disposed within an axial channel through a brush, and the other end of the shaft is shaped as a screwdriver blade.

6 Claims, 4 Drawing Sheets

MULTIFUNCTION TOOL FOR SERVICING CHAIN SAWS

The present invention relates to multi-function tools for facilitating mechanical operations. More particularly, the present invention relates to tools for servicing chain saws.

BACKGROUND OF INVENTION

Chain saws are heavy-duty devices for cutting wood, particularly trimming and removing trees as required to maintain a house or fell trees in lumbering. Chain saws are also used in the creation of works of art such as wood carvings and ice sculptures. While chain saws reduce the hard work of such tasks, they unfortunately require significant maintenance and repair. Chain saws are prone to clogged fuel lines, clogged air, fuel and oil filters, hard starting engines and under tensioned chains.

A chain saw functions by cutting material from a work piece, thus forming sawdust and chips, and hence its very use creates debris which tends to accumulate on various parts of the chain saw. Unfortunately, the debris created by the chain saw is one of the major causes of malfunction of the chain saw, particularly air, fuel and oil related problems.

Many chain saw users recognize that the dust, dirt and debris produced by the chain saw is a threat to trouble-free operation of the chain saw, and they carry a brush in their toolboxes which can be used to clean the caps on the gasoline tank and oil reservoir and the areas around the caps, before opening the caps. Such brushes are effective in preventing saw dust, chips and other debris from entering the gasoline tank or oil tank; however, unattached brushes tend to be unavailable. Such brushes tend to get lost or fall to the ground when the chain saw is being used on a scaffold or the like. Mounting a brush on the chain saw will not solve this problem as illustrated by U.S. Pat. No. 4,748,745 to R. G. Woodbridge entitled Chain Saw Brush For Cleaning Saw Cuts. This patent discloses the combination of a chain saw and a brush mounted thereon, but the brush can only be used on surfaces other than that of the chain saw itself.

Accordingly, it is an object of the present invention to provide a brush for brushing a chain saw which will tend to be accessible when servicing the chain saw.

A common problem encountered by those who use chain saws is that the chain of the saw loosens during performance of a job and the chain must be tightened before the job is completed. The chain rides on the perimeter of a blade which is mounted on the frame of the saw confronting a sprocket for driving the chain, the blade extending outwardly from the sprocket. U.S. Pat. No. 2,765,821 to L. M. Strunk discloses a means to adjust the distance between the chain sprocket and the blade to adjust the tension on the chain. This 1956 patent discloses a chain saw blade tensioning device in which the blade of the saw has a slot extending therein on the longitudinal axis of the blade and confronting the chain sprocket, and a pair of threaded studs extend through the slot and are engaged by a pair of nuts that retain the blade in position relative to the sprocket. The chain may be tightened by loosening the nuts, moving the blade further away from the chain sprocket, and thereafter tightening the nuts. Similar saw tensioning devices that employ nuts to secure the blade of the saw at a proper distance from the chain sprocket are in use on most of the chain saws today . . . .

Accordingly, almost all chain saw users carry a tool in their tool boxes to release the nuts that hold the blade of the saw in order to adjust the tension on the chain and to tighten the nuts to retain the tension on the chain. Also, most chain saw users carry a screwdriver in their tool boxes to engage the many devices on a chain saw that are facilitated by a screwdriver, such as loosening caps on gasoline and oil ports. For convenience, a combination screwdriver and wrench has been provided for servicing chain saws, and this device is generally referred to as a "scrench." It has a tube with sockets for nuts of different sizes at opposite ends, a shaft extending normally from the tube and a screwdriver blade disposed at the end of the shaft opposite the tube. The two sockets at opposite ends of the tube are designed to engage nuts of two different sizes that are found on chain saws, and the screwdriver blade is designed to engage air filter closures and gasoline and oil caps found on chain saws.

It is an object of the present invention to provide a tool for use with a chain saw that functions as a brush, a nut driver and a screw driver.

Further, it is an object of the present invention to provide a tool that is a combination of a wrench, a screwdriver and a brush in which the screwdriver function is facilitated by the wrench and the wrench and brush functions are facilitated by the screwdriver.

Further, it is an object of the present invention to provide a tool that is a combination of a wrench, a screwdriver and a brush in which the screwdriver function is not impaired by the wrench or brush, the wrench function is not impaired by the screwdriver or brush and the brush function is not impaired by the wrench or screwdriver.

SUMMARY OF INVENTION

The objects of this invention are achieved by a tool that provides a nut driver function, a screw driver function and a brushing function. In the preferred embodiment, a tool is provided with an elongated tube that has recesses at opposite ends thereof forming sockets of different sizes for engaging nuts, a shaft having one end mounted on the tube and extending from the tube to a screwdriver blade at the other end, and a brush slidably disposed between two spaced positions on the shaft. This compact unitary tool performs the functions of a nut driver, a screwdriver and a brush.

In each case the performance of the function is not adversely affected by the presence of equipment for performing one or more of the other functions of the tool. Further, each of the functions of the tool is aided by the presence of equipment for performing one or more of the other functions, as indicated by Table 1 hereinafter.

TABLE 1

| Function | Effect On Screwdriver | Effect on Nut Driver | Effect on Brush |
|---|---|---|---|
| Screwdriver | | Shaft provides torque | Shaft forms handle<br>Blade is end stop |
| Nut Driver | Tube is torque bar | | Stop at end of shaft |
| Brush | No significant effect | No significant effect | |

The invention also includes a second embodiment in which the screwdriver device described above is replaced by screwdriver device that is designed to couple to screws with multiple slots or non-planar slot configurations, such as Phillips screws. Screwdrivers for such screws generally have cylindrical shafts and accordingly a screwdriver for such screw heads does not have a shaft with protrusions that will form a stop to retain the brush on the shaft. In this embodiment, the shaft carries a ring that surrounds the shaft and protrudes therefrom sufficiently to engage the brush and form a stop.

BRIEF DESCRIPTION OF DRAWINGS

For a more complete understanding of the invention, reference is made to the accompanying drawings, in which.

DESCRIPTION OF THE PREFERRED EMBODIMENTS

Figure 1:
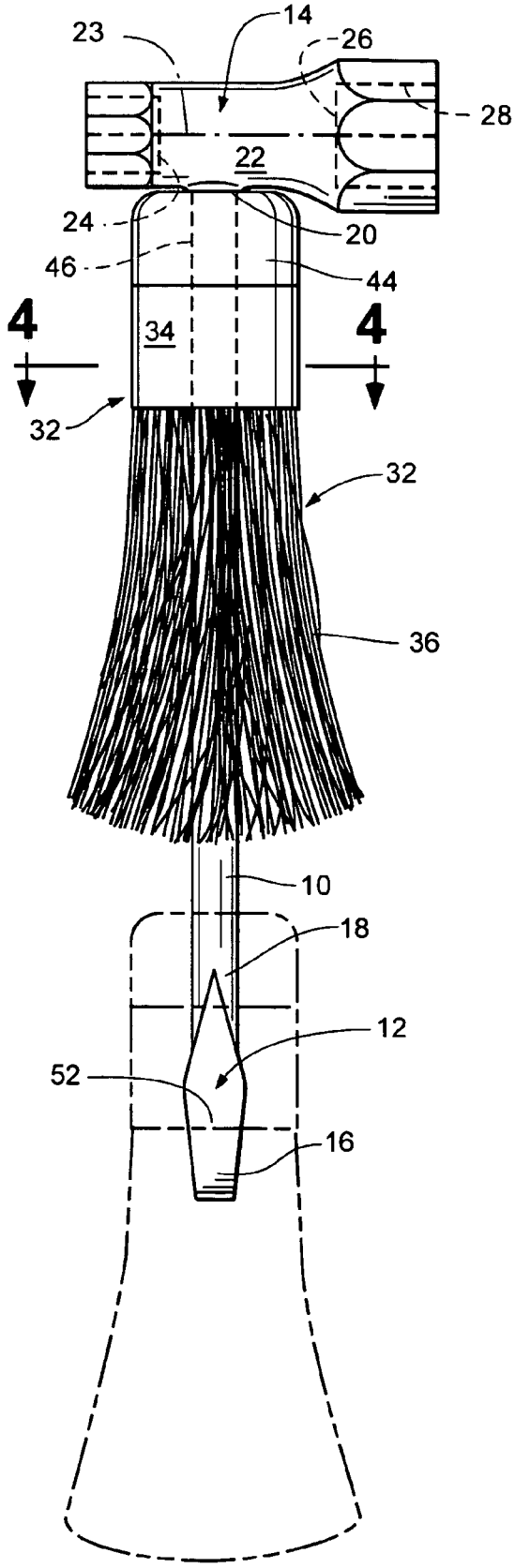
FIG. 1 is an elevational view of a tool constructed according to the present invention with the brush retracted for use as a screwdriver and illustrating in dotted lines the brush in position for use as a brush.
Figure 2:
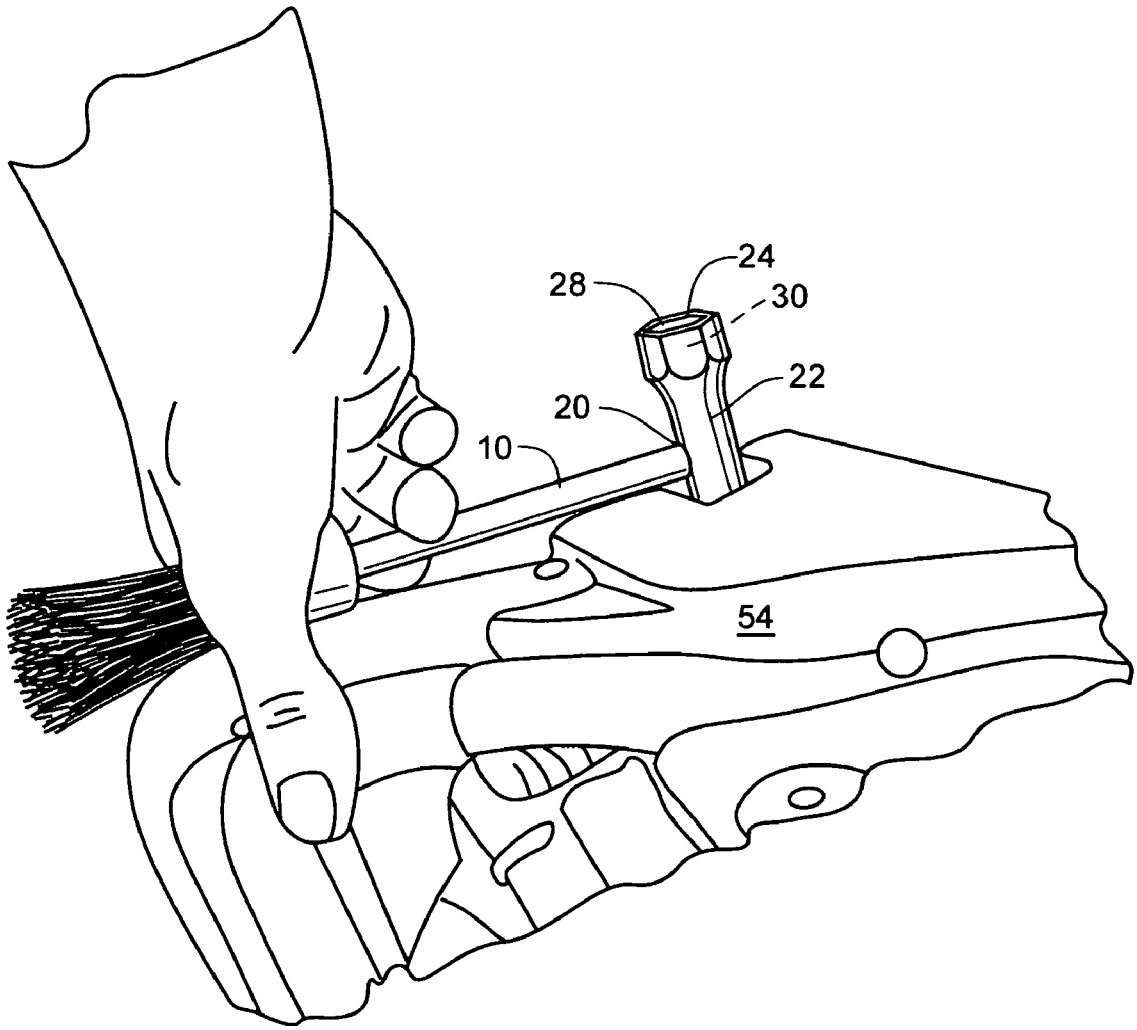
FIG. 2 is an elevational view illustrating the tool of FIG. 1 positioned to engage the cap on the gasoline port of a chain saw with the nut driver, the brush being positioned confronting the screwdriver blade.
Figure 3:
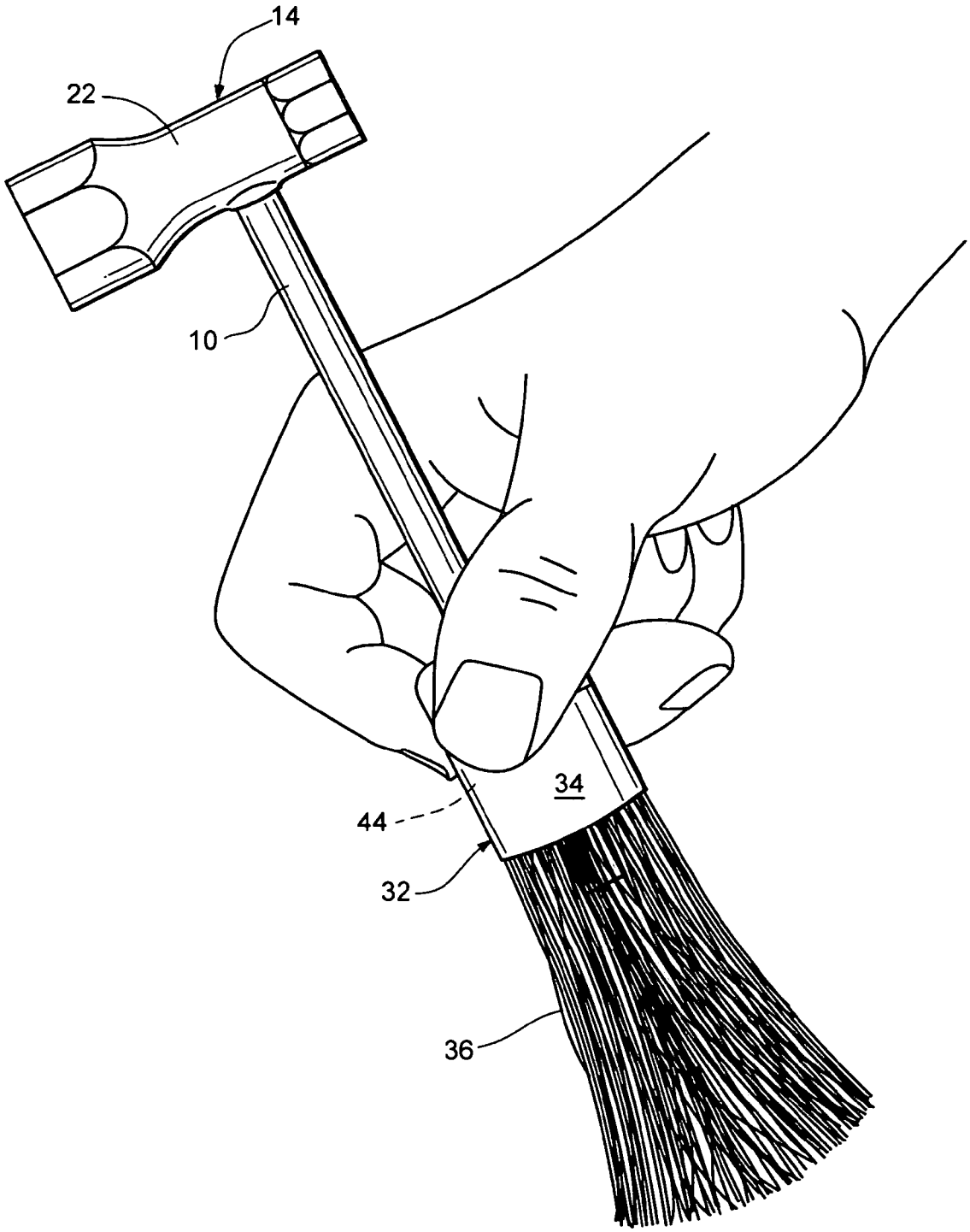
FIG. 3 is an elevation of view of the tool of FIG. 1 configured for use of the brush function, the brush being positioned confronting the screwdriver blade.

FIGS. 1 through 3 illustrate a preferred embodiment of the present invention. A multipurpose tool according to the present invention has an elongated shaft 10 that extends between a screw driving device 12 and a nut driving device 14. The shaft 10 is constructed of rigid material such as iron or steel, and is linear. In the illustrated construction, the shaft 10 has a circular cross-section, but it could also be non-circular. The screw driving device 12 in the illustrated construction is a blade 16 that is integral with the shaft 10 and extends outwardly from the end 18 thereof opposite the nut driving device 14.

The nut driving device 14 is mounted on the end 20 of the shaft 10 opposite the screw driving device 12. In the illustrated construction, the nut driving device 14 has a body in the form of an elongated tube 22 with a central axis 23. The tube 22 is mounted on the end 20 of the shaft 10 normal to the axis of the shaft and is provided with socket forming recesses 24 and 26 at opposite ends of the tube. The recesses 24 and 26 have walls 28 consisting of flat segments 30 that are substantially parallel to the central axis of the tube 22, and in each of the recesses 24 and 26, each segment 30 is attached to adjacent segments on axes parallel to the central axis of the shaft and of equal length, whereby each recess 24 and 26 forms a socket that is adapted to engage a nut. The nut driving device 14 may use a body of another shape, such as a sphere, or the central axis of the tube may not be perpendicular to the axis of the shaft, but the central axes of the recesses 24 and 26 that form the sockets of a wrench should be preferably substantially normal to the axis of the shaft 10 to optimally transfer torque from the shaft to the wrench sockets.

Figure 4:
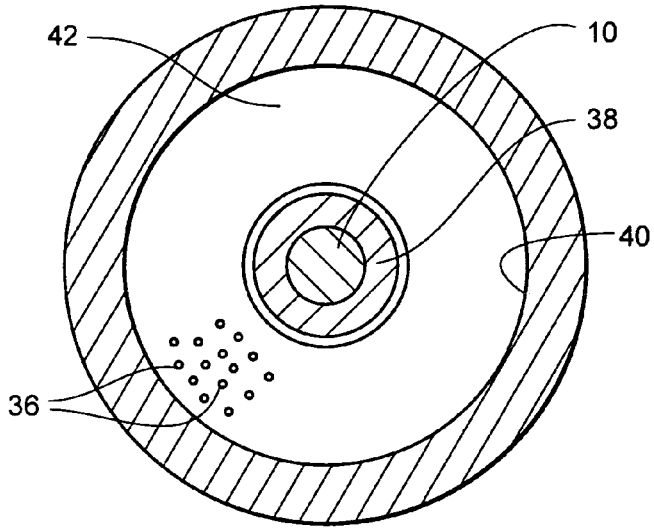
FIG. 4 is a sectional view taken along the line 4-4 of FIG. 1.

As best illustrated in FIGS. 1 and 4, a brush 32 is slidably mounted on the shaft 10 by a base 34, and the brush has a plurality of bristles 36 mounted at one end thereof on the base, the bristles 36 extending outwardly from the base 34 and away from the end 20 of the shaft 10. The base 34 has a generally cylindrical shape with a central axis of elongation. A channel 38 extends coaxially through the base 34 and slidably accommodates the shaft 10. The base 34 also has an annular recess 40 extending therein from the end thereof opposite the nut driving device 14 and coaxial with the shaft 10. One end of each of the bristles 36 is disposed within the annular recess 40 and anchored therein by a mass of adhesive cement 42, each of the bristles extending from the base 34 generally parallel to the axis of the shaft 10. A circular cap 44 having a central channel 46 coaxial with the channel 38 of the base 34 is mounted by cement (not shown) on the end of the base 34 opposite the annular recess 40.

In the preferred construction described above, the screwdriver blade 16 has a pair of flat surfaces 48 which depend from the end 18 of the shaft 10 at a slight angle to the central axis of the shaft and terminate in a thin straight edge 50 that is disposed normal to the axis of the shaft. The blade 16 also has a transverse axis 52 parallel to the flat surfaces 48 and disposed generally centrally between the straight edge 50 and the end 18 of the shaft 10. The transverse axis 52 is sufficiently longer than the cross-sectional length (or diameter) of the shaft 10 to form a stop against translation of the brush 32 from the shaft 10. In one construction, the shaft 10 is cylindrical and has a diameter of 5/16 inch. The channel 46 through the base 34 and cap 44 is also cylindrical having a diameter of about 3/8 inch, but the transverse axis 52 of the screwdriver blade 16 is approximately 7/16 inch long and forms a stop against translation of the brush 32 over the blade and off of the shaft 10. In this construction, the brush 32 is 4¼ inches long, and the shaft 10 is 6½ inches long, and when the brush 32 is translated to the stop position adjacent to the blade 16, there are approximately 4 inches between the nut driving device 14 and the cap 44 off the brush 32. As indicated in FIG. 3, this space of 4 inches is sufficient for a chain saw operator to hold the brush 32 free of interference by the nut driving device 14 . . . . Also, as illustrated in FIG. 2, with the brush 32 in this position, the nut driving device 14 is in position to engage a nut or cap of a fuel or oil port on a chain saw 54. With the tool in this configuration, the entire length of the shaft 10 can be utilized to generate torque on the tube 24 for loosening or tightening a nut or the like.

Figure 5:
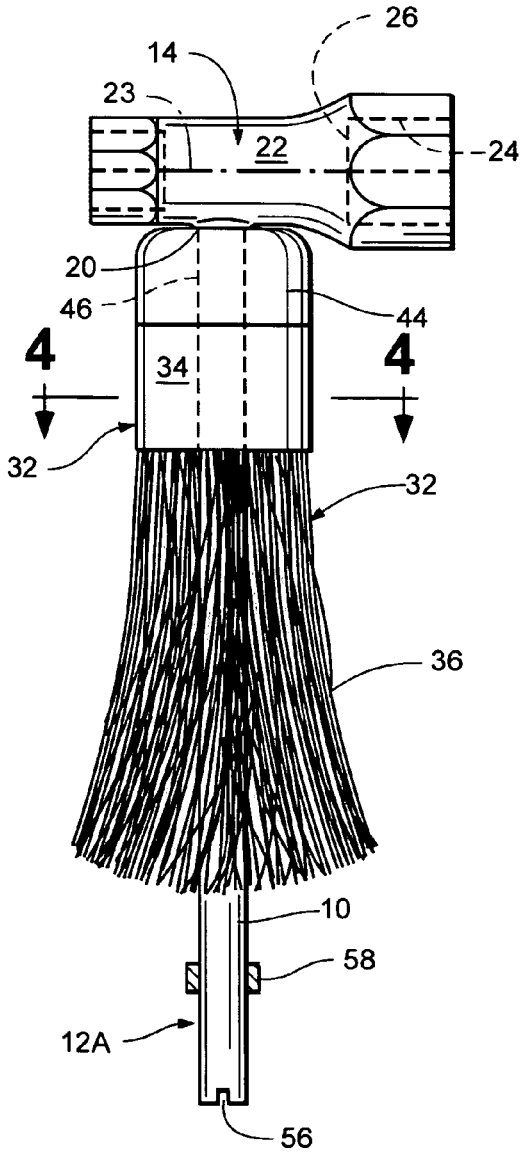
FIG. 5 is an elevational view of a tool that constitutes another embodiment of the present invention, the brush being retracted for use of the tool as a screwdriver.

FIG. 5 illustrates another embodiment of the present invention. Powered screwdrivers are generally designed to engage screw heads provided with more than one slot for coupling the screw to the screwdriver, and FIG. 5 illustrates a tool according to the present invention that is adapted to engage such screw heads. Except for the screw driving device 12A and stop at the end 18 of the shaft 10, the embodiment of FIG. 5 is identical to that of FIG. 1, and the same reference numerals and description presented above apply to FIG. 5.

This screw driver device 12A is integral with the shaft 10, and consists of one or more slots 56 that extend from at least the axis of the shaft 10 to the perimeter of the shaft. The slots 56 may traverse the diameter of the shaft 10, or be radial such as required to accommodate Phillips screws. Since the diameter of the screw driver device 12A is the same as the shaft 12 throughout its length, there is no protrusion to function as a stop to prevent the brush 32 from being translated off of the end 18 of the shaft. A stop is provided by securing a ring 58 on the shaft 10 at the end 18 of the shaft 10. The outer diameter of the ring 58 is greater than the diameter of the channel 46 in the brush 32, and the ring and shaft form a stop to translation of the brush 32 at the end 18 of the shaft 10.

The ring 58 may be constructed of metal and secured to the shaft 10 by welding or the like. Also, the ring 58 may be constructed of plastic and cemented on the shaft 10. The ring may also be a strip of tape with an adhesive backing on one side, the tape being wound about the shaft 10 to form the ring 58. Forming the ring 58 with adhesive tape permits replacement of the brush 32 should it become worn, or the addition of a brush to a tool with a screw driver function and a nut driver function but without a brush function.

Those skilled in the art will devise additional constructions within the scope of the present invention. It is therefore intended that the scope of this invention be not limited by the foregoing specification, but rather only by the appended claims.

The invention claimed is:

1. A multifunction tool comprising an elongated shaft constructed of rigid material having a central linear axis extending from one end to another end, the one end of said shaft having a contour adapted to engage the contour on the head of a screw and a protrusion extending from the shaft adjacent to the one end thereof, a body mounted on the other end of the shaft having a recess extending therein on an axis normal to the central axis of the shaft, said recess forming a wall having a plurality of interconnected flat segments disposed parallel to said axis of the recess forming a socket for engaging a nut, and a brush having a base with spaced opposed ends and a central axis extending between said ends, said base having a channel extending therethrough on the central axis thereof, said base of the brush being slidably mounted on the shaft, said brush having a first stop position formed by the one end of the base abutting the body at the other end of the shaft and a second stop position formed by the other end of the base abutting the protrusion adjacent to the one end of the shaft, the brush having bristles mounted on the other end of the base and extending therefrom, said bristles being of sufficient length to extend beyond the one end of the shaft when in the second stop position.

2. A multifunction tool according to claim 1 wherein the contour of the one end of the shaft adapted to engage the contour on the head of a screw is a blade having a central linear axis disposed coaxially with the shaft, said blade having confronting flat surfaces that depend towards each other forming a thin straight edge for engaging screws.

3. A multifunction tool according to claim 2 wherein the measurement of the confronting flat surfaces of the shaft along a transverse axis spaced from the blade edge and normal to the axis of the shaft is longer than the cross-sectional width of the channel of the brush defining said protrusion, whereby the blade forms a stop for translation of the brush.

4. A multifunction tool according to claim 1 wherein the cross sectional distance between opposite sides of the shaft measured on all transverse axes of the shaft are shorter than the distance between confronting portions of the wall of the brush channel, in combination with a ring secured about the shaft adjacent to the one end of the shaft, said ring having an outer surface with a length measured on an axis transverse to the shaft greater than the length of the transverse axes of the channel of the brush, thereby defining said protrusion.

5. A multifunction tool according to claim 1 wherein the body mounted on the other end of the shaft is an elongated linear body extending normal to the shaft, said body having a central axis extending between opposite ends thereof and wherein said recess extends therein from each of the opposite ends thereof forming opposed recesses, each of said recesses having a wall disposed parallel to the central axis of the body consisting of a plurality of segments attached to each other along axes disposed parallel to the central axis of the recesses, the axes of each recess being at a common distance from the central axis of the body and said common distance of the axes of one of the recesses being longer than the common distance of the axes of the other recess, whereby said recesses form sockets that are adapted to engage nuts of two different sizes.

6. A multifunction tool comprising an elongated shaft constructed of rigid material having a central linear axis and a screwdriver blade disposed at one end thereof, said screwdriver blade having a central linear axis disposed coaxial with the shaft, an elongated linear tube mounted on the other end of the shaft and extending normal to the shaft, said tube having a central axis of elongation extending between opposite ends thereof and a recess extending therein from each end thereof forming opposed recesses, each of said recesses having a wall disposed parallel to the central axis of the tube consisting of a plurality of segments attached to each other along axes disposed at a common distance from the central axis of the tube, each of said recesses forming a socket that is adapted to engage a nut, and a brush having a base and a plurality of bristles extending outwardly from the base, means for slidably mounting the base of the brush on the shaft with said bristles disposed generally parallel to the central axis of the shaft with the base of the brush confronting the tube, said means for mounting the brush on the shaft permitting manual translation of the brush to a position in which the base confronts the blade of the screwdriver and the bristles of the brush extend outwardly from the screwdriver blade.

* * * * *